US006517164B1

(12) United States Patent
White

(10) Patent No.: US 6,517,164 B1
(45) Date of Patent: Feb. 11, 2003

(54) HAMMER-RIPPER EXCAVATING SYSTEM

(76) Inventor: Richard E. White, P.O. Box 3892, Camp Verde, AZ (US) 86322

( * ) Notice: Subject to any disclaimer, the term of this patent is extended or adjusted under 35 U.S.C. 154(b) by 0 days.

(21) Appl. No.: 09/633,380

(22) Filed: Aug. 7, 2000

(51) Int. Cl.[7] ..... E21C 25/02

(52) U.S. Cl. ..... 299/37.5; 299/36.1; 299/69; 172/62; 173/93; 37/447

(58) Field of Search ..... 299/37.1, 37.2, 299/38.1, 37.3, 37.4, 37.5, 36.1, 65, 69, 71; 172/62, 710, 93, 498, 705, 664; 173/93, 130, 211, 132, 118; 37/408, 409, 447, 457, 458, 904, 380, 466, 303; 414/723, 724, 726

(56) References Cited

U.S. PATENT DOCUMENTS 3,997,068 A * 12/1976 Lock ..... 214/145
4,003,603 A * 1/1977 Stemler et al. ..... 299/37
4,249,614 A * 2/1981 van der Lely ..... 172/261
4,379,595 A * 4/1983 Roussin et al. ..... 299/37
4,453,772 A * 6/1984 Roussin ..... 299/37
4,602,821 A * 7/1986 Schaeff ..... 299/67
4,906,049 A * 3/1990 Anderson ..... 299/37
5,072,993 A * 12/1991 Dickerson ..... 299/37
5,094,017 A * 3/1992 Matsumoto et al. ..... 37/2 R

* cited by examiner

*Primary Examiner*—David Bagnell
*Assistant Examiner*—Daniel P Stephenson
(74) *Attorney, Agent, or Firm*—Martin L. Stoneman

(57) ABSTRACT

A hammer-ripper system for use with the mounting on the boom arm, of an excavator/backhoe, of a conventional hydraulically-operated hammer fitted with a "shortened" chisel. A "ripping-type" device like a chisel tooth mounts to a lever with its pivot point attached to the side of the hammer. One end of the lever extends to be impacted by under the shortened chisel, while the other end extends inward. Thus, the tooth end can be placed under embedded boulders and used to hammer (using the transmitted reciprocating action of the hydraulic hammer), and pry or break up the boulders from underneath with the combined hammering and ripping action.

20 Claims, 2 Drawing Sheets

HAMMER-RIPPER EXCAVATING SYSTEM

BACKGROUND

Typically, in the construction industry, various types of hydraulically-operated equipment are used to excavate both natural and man-made materials. For instance, hydraulic shovels (also called excavation buckets), often mounted on backhoes, are often used to remove typical soils. However, hydraulic shovels are not adequate for harder materials such as solid rock or large boulders. Hydraulically-operated hammers (also called impact tools or breakers) mounted on a backhoe/excavator are used to break up rock or concrete. Hydraulically-operated hammers pound in a downward direction only, which is useful to break boulders. However, hydraulically-operated hammers typically cannot be used to pry up boulders or to get under boulders and pound them upward to loosen them from surrounding material. Other devices such as excavator buckets and rippers can be used to pry up buried boulders, but are not able to hammer. Thus, there is needed a more efficient system for such excavating work.

OBJECTS OF THE INVENTION

A primary object and feature of the present invention is to fulfill the above-mentioned needs by the provision of a device that would attach to an excavating machine, mounted with a hydraulically-operated hammer, that is constructed to be used to pry up or break-up buried boulders from underneath. A further primary object of the present invention is to provide such a device or system which is efficient, inexpensive, and handy. Other objects of this invention will become apparent with reference to the following descriptions.

SUMMARY OF THE INVENTION

According to a preferred embodiment of the present invention, this invention provides a system for providing combination impact and other forces during excavation of material, comprising, in combination: a transmitting means for transmitting reciprocating impact forces in a first direction; a direction-changing means, removably attached to such transmitting means, for receiving such reciprocating impact forces from such transmitting means and for changing such first direction of such reciprocating impact forces to a second direction; and an impact means, connected with such direction-changing means, for providing combination impact, in such second direction, and other forces to the material. It also provides such system wherein such other forces comprise ripping forces. And it provides such system wherein such transmitting means comprises a hydraulically actuated impact hammer; and, further, wherein such direction changing means comprises a lever; and, further, wherein such impact means comprises a ripper tooth.

In addition, the present invention provides, in accordance with a preferred embodiment thereof, a system for providing combination impact and other forces during excavation of material, comprising, in combination: an impact-force transmitter structured and arranged to transmit reciprocating impact forces in a first direction; a force redirector, removably attached to such impact-force transmitter, structured and arranged to receive such reciprocating impact forces from such impact-force transmitter and to change such first direction of such reciprocating impact forces to a second direction; and a force-transmitting tool, connected with such force redirector, structured and arranged to provide combination impact, in such second direction, and other forces to the material. It also provides such system further comprising an excavator apparatus including a boom arm connected to such impact-force transmitter. In addition, it provides such a system further comprising a connector between such impact-force transmitter and such force redirector structured and arranged to provide connection both in an operating position and a stowed position. It also provides such a system wherein such impact-force transmitter comprises a hydraulically actuated impact hammer.

Still further, it provides such a system wherein such connector is structured and arranged to permit normal operation of such hydraulically actuated impact hammer with such force redirector connected in a such stowed position. It also provides such a system wherein such force-transmitting tool comprises a ripper element. Moreover, the present invention provides such a system wherein such ripper element comprises a tooth. And it provides such a system wherein such force redirector comprises a lever having a pivot pin, a first lever side, and a second lever side. It also provides such a system wherein such first lever side comprises a strike plate structured and arranged to receive such reciprocating impact forces from such impact-force transmitter. Further, it provides such a system wherein such second lever side comprises a tool connector structured and arranged to permit a removable connection to such force-transmitting tool; and, further, wherein such tool connector comprises a return spring for such lever. And it provides such a system wherein such pivot pin is mounted on such impact-force transmitter and such force redirector is rotatably mounted on such pivot pin.

In addition, the present invention provides such a system further comprising a connector between such impact-force transmitter and such force redirector structured and arranged to provide connection both in an operating position and a stowed position, wherein: such impact-force transmitter comprises a hydraulically actuated impact hammer; such connector is structured and arranged to permit normal operation of such hydraulically actuated impact hammer with such force redirector connected in a such stowed position; such force-transmitting tool comprises a ripper element; such ripper element comprises a tooth; and when in such stowed position, such second lever side of such force redirector is attachable with hydraulically actuated impact hammer. And it provides such system further comprising an excavator apparatus including a boom arm connected to such impact-force transmitter.

Moreover, the present invention provides, in accordance with a preferred embodiment thereof such system for providing combination impact and other action for assisting in displacing material, comprising, in combination: an impactor tool structured and arranged to provide a rapid series of power-driven impacts in a first direction; and a second tool, removably attached to such impactor tool, structured and arranged to provide an other action than impacting, and to be impacted upon by such impactor tool, and to combine impact action with such other action to act upon the material.

Further, the present invention provides, in accordance with a preferred embodiment thereof, a system for providing combination hammering and ripping forces during excavation of material, comprising, in combination: a hydraulic hammer tool structured and arranged to produce a reciprocating action in a first direction; and a ripping tool, removably attached to such hydraulic hammer tool, structured and arranged to provide a ripping action, and to be moved by such reciprocating action, and to combine forces from such reciprocating action with such ripping action to act upon the material.

DETAILED DESCRIPTION OF A PREFERRED EMBODIMENT AND THE BEST MODE OF PRACTICE

Figure 1:
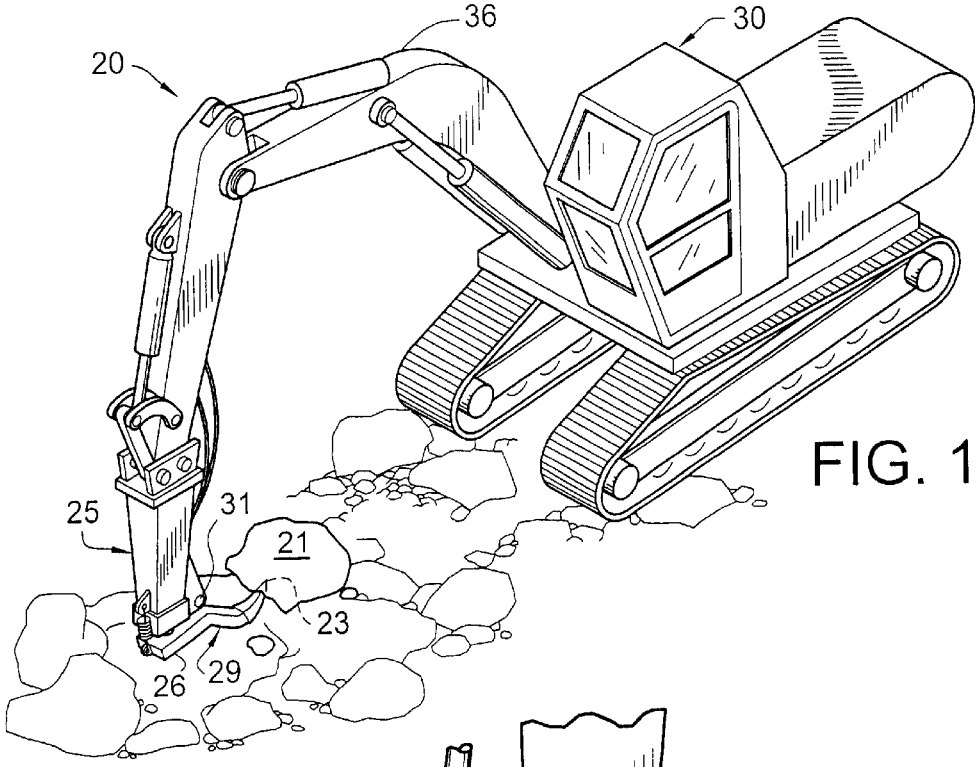
FIG. 1 is a perspective view of an excavating apparatus with a hydraulically actuated impact hammer and incorporating a preferred embodiment of the hammer-ripper system of the present invention.

Illustrated in FIG. 1 is a perspective view illustrating a preferred embodiment of an excavating hammer-ripper system 20 of the present invention, and further illustrating a hammer-ripper attachment 29 shown in its preferred combination with a hydraulically-actuated impact hammer 25 connected to a typical hydraulic excavating apparatus 30 (commonly referred to as a tractor backhoe). It is well known by those skilled in the art, with respect to hydraulic excavating apparatus 30 or similar equipment, that the excavator boom arm 36 is manufactured so as to allow for a variety of extensions or other devices to be attached to the excavator boom arm 36 for the purposes of excavation or any other of a variety of purposes for which the hydraulic excavating apparatus 30 is well suited. The hydraulically-actuated impact hammer 25 (embodying herein a transmitting means for transmitting reciprocating impact forces in a first direction and also embodying an impact-force transmitter structured and arranged to transmit reciprocating impact forces in a first direction) is typical with respect to attachment means for hydraulic excavating apparatus 30 and is typically actuated by pressurized oil flow. It should be noted that the preferred hydraulic excavating apparatus 30 may, for suitable applications, be replaced by other suitable excavating apparatus provided with a corresponding, arbitrarily positioned, preferably-hydraulically-operated hammer.

FIG. 1 illustrates a preferred use of the present invention, i.e., removal and/or break-up of large rock 21 or other similar hard material while excavating. The operator of hydraulic excavating apparatus 30 positions the excavator boom arm 36 such that the tip 23 of the chisel tooth attachment 27 of the excavating hammer-ripper attachment 29 is located beneath the material to be removed (here illustrated as rock 21). The hydraulically-actuated impact hammer 25 is activated in a normal manner as force is applied against the tip 23 of the chisel tooth attachment 27 and a corresponding force is thereby transferred by the lever arm sub-assembly 26 to the shortened chisel 33 of the hydraulically-actuated impact hammer 25. The hydraulically-actuated impact hammer 25 is activated and a hammering force is then transferred by the lever arm sub-assembly 26 to the tip 23 of the chisel tooth attachment 27 (embodying herein an impact means, connected with such direction-changing means, for providing combination impact, in such second direction, and other forces to the material and also embodying a force-transmitting tool, connected with such force redirector, structured and arranged to provide combination impact, in such second direction, and other forces to the material). The hammer action combined with the ripping/prying action as the excavator boom arm 36 pulls on the tip 23 of the chisel tooth attachment 27 (thereby applying a ripping force) loosens the rock and will usually facilitate removal of the rock and/or resulting pieces. This arrangement embodies herein a system for providing combination hammering and ripping forces during excavation of material, comprising, in combination: a hydraulic hammer tool structured and arranged to produce a reciprocating action in a first direction; and a ripping tool, removably attached to such hydraulic hammer tool, structured and arranged to provide a ripping action, and to be moved by such reciprocating action, and to combine forces from such reciprocating action with such ripping action to act upon the material. The present invention may be best used where traditional overhead means to break up rock are not efficient and the preferred method is to get under the rock or hardened material and pry it up, loosen it for removal, or break it apart for removal.

Figure 2:
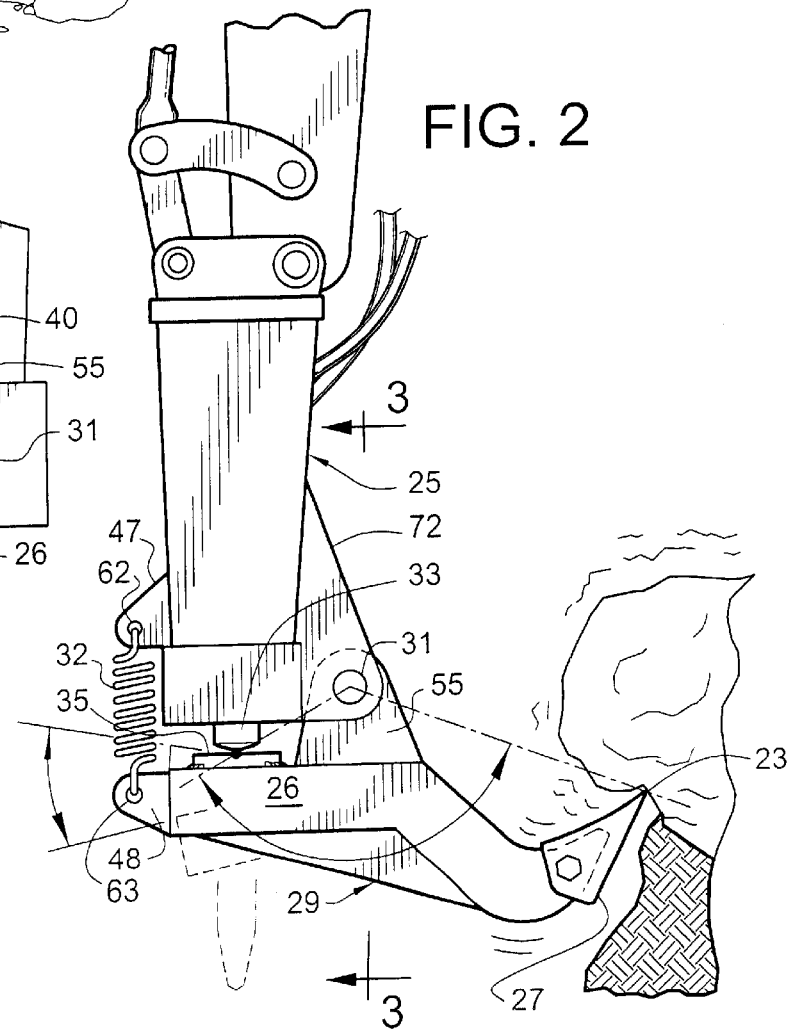
FIG. 2 is a partial elevation view of the embodiment of FIG. 1.

FIG. 2 is a partial side elevation of the embodiment of FIG. 1, illustrating an excavating hammer-ripper attachment 29 (embodying herein a direction-changing means, removably attached to such transmitting means, for receiving such reciprocating impact forces from such transmitting means and for changing such first direction of such reciprocating impact forces to a second direction and also embodying a force redirector, removably attached to such impact-force transmitter, structured and arranged to receive such reciprocating impact forces from such impact-force transmitter and to change such first direction of such reciprocating impact forces to a second direction) attached to a hydraulically actuated impact hammer 25. Hydraulically actuated impact hammer 25 is of the type frequently used for breaking up rock, concrete or other hardened materials. Hydraulically actuated impact hammer 25 is typically mounted to a backhoe or other excavating apparatus 30 which positions and pushes hammer 25 against rock to be broken up. Hydraulic fluid pressure is supplied to a valve in a well-known manner, which causes a piston within the impact hammer 25 to cycle and correspondingly deliver impacting blows to an end device such as a hardened chisel 49 (see FIG. 5). In the preferred embodiment as shown in FIGS. 1–2, the present invention is shown in an operating mode. The lever arm sub-assembly 26 is shown transferring the impact energy from the hydraulically actuated impact hammer 25 to the chisel tooth attachment 27 of the present invention and against a rock 21. The transference of force/energy from the hydraulically actuated impact hammer 25 to the chisel tooth attachment 27 occurs as the impact hammer shortened chisel attachment 33 impacts the strike plate 35, a part of hammer-ripper attachment 29, as shown. This force/energy is then transferred through the lever arm sub-assembly 26 to the chisel tooth attachment 27.

As shown in FIG. 2, a spring 32 is attached at one end of the lever arm sub-assembly 26 by a lever arm spring receiving bracket 48 having a lever arm spring receiving aperture 63. The other end of the spring 32 is attached to the hydraulically actuated impact hammer 25 by means of a spring receiving bracket 47 having a spring receiving aperture 62. The return spring 32 assists continual forcing of strike plate 35 toward the shortened chisel attachment 33 of the hydraulically actuated impact hammer 25 sufficient to allow the lever arm sub-assembly 26 to be returned in position after each impact of shortened chisel attachment 33 of the hydraulically actuated impact hammer 25 against the strike plate 35, thus facilitating the impact of the chisel tooth attachment 27 against the rock 21 or similar material to be removed.

This transference of the force/energy from the hydraulically actuated impact hammer 25 to the chisel tooth attachment 27 combined with the ripping action of the excavating apparatus 30 as it pulls or pushes the excavating boom arm 36, transfers additional force upon the chisel tooth attachment 27 (this arrangement embodying herein an excavator apparatus including a boom arm connected to such impact-force transmitter. Preferably, the combined action of the hydraulically actuated impact hammer 25 and the ripping action of the excavating boom arm 36 results in the break-up, prying up, or loosening and finally, removal, of the item to be excavated. Further, it is noted that the preferred chisel tooth attachment 27 can, for suitable purposes, be replaced by every suitable types of detachable tooths used for such excavating purposes.

Figure 3:
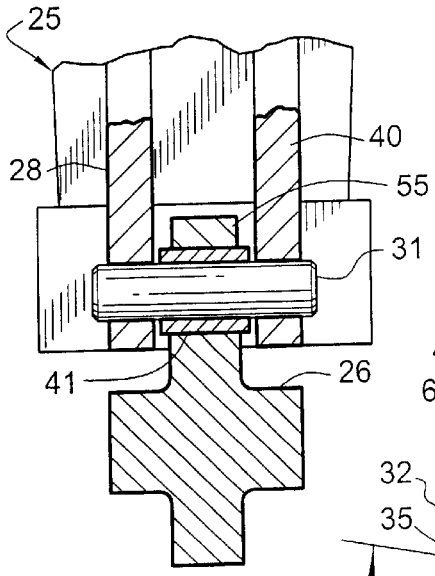
FIG. 3 is a partial cross-sectional view, through the section 3—3 of FIG. 2.
Figure 4:
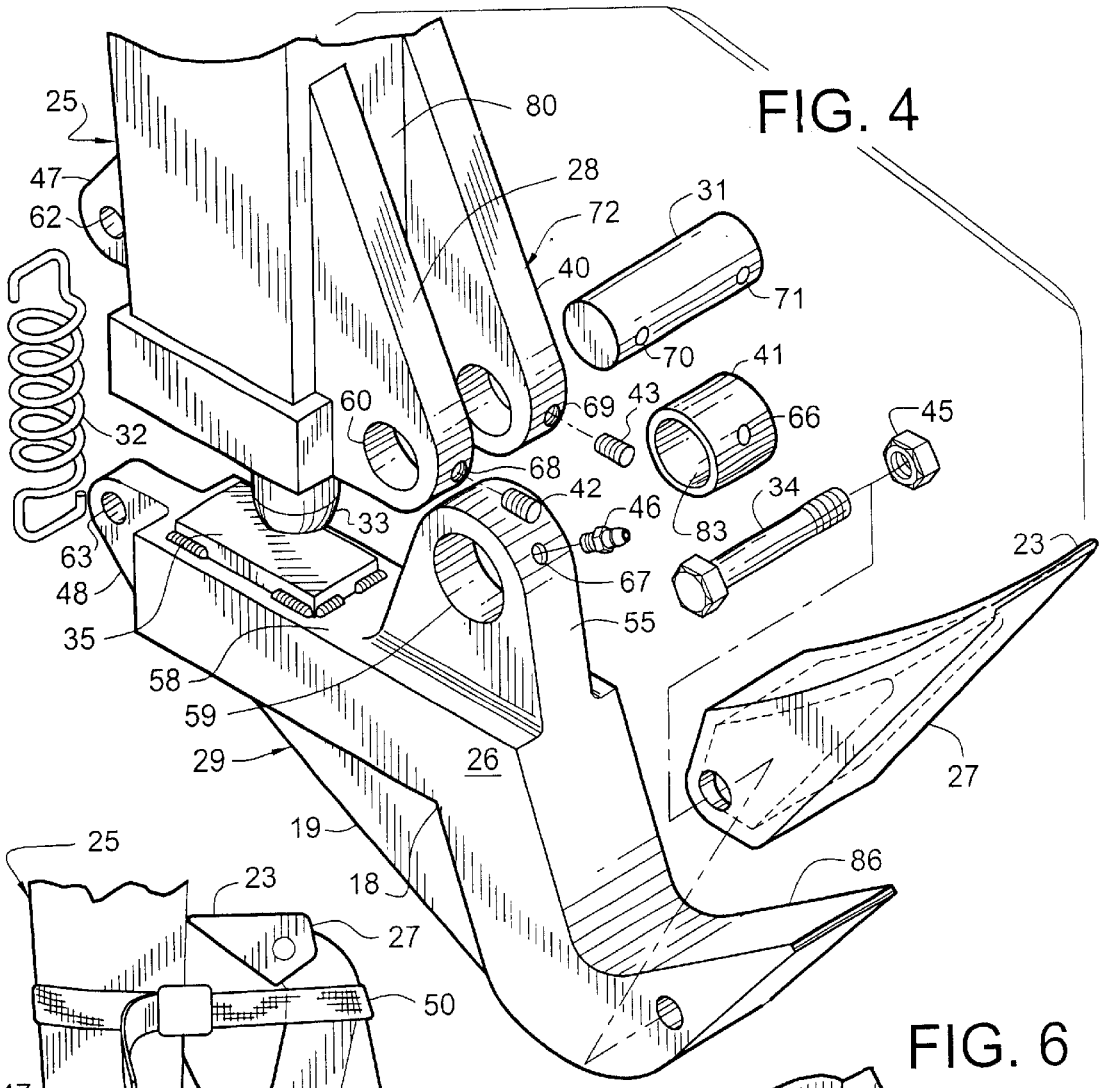
FIG. 4 is a perspective exploded view of the bottom end of the embodiment of FIG. 1.

FIG. 3 is a cross section through section 3—3 of FIG. 2, especially illustrating a preferred connecting method for the preferred embodiment of the excavating hammer-ripper attachment 29 to the impact hammer 25. This Figure is further described with reference to discussion of FIG. 4. FIG. 4 further illustrates this connection in an exploded perspective view showing the basic components of the excavating hammer-ripper attachment 29. The preferred basic construction consists of a central lever arm sub-assembly 26 with an attached rear lower flange 48 at one end. An attached upper flange 55 is mounted to the top of the lever arm sub-assembly 26 in such position to make connection to the connector subassembly 72 of the impact hammer 25. The front portion of the lever arm sub-assembly 26 consists of a ripper-type tooth body 86 which has removable, partially-hollow chisel tooth attachment 27 fitting over and secured to the ripper-type tooth body 86 by securing bolt 34 and nut 45. As mentioned, rear lower flange 48 has a spring receiving aperture 63; and upper flange 55 has a sleeve receiving aperture 59. Connecting pin sleeve 41 preferably pressure fits into sleeve receiving aperture 59. Both upper flange 55 and connecting pin sleeve 41 are preferably further attached to each other by sleeve set screw 46 inserted through a pre-drilled aperture 67 in upper flange 55 and a threaded aperture 66 in connecting pin sleeve 41. The above arrangement embodies herein a system wherein such force redirector comprises a lever having a pivot pin, a first lever side, and a second lever side.

At the upper portion of lever arm sub-assembly 26, posterior of the upper flange 55 on the upper lever arm surface 58 of the lever arm sub-assembly 26 is a strike plate 35. Strike plate 35 is preferably welded to the upper lever arm surface 58 and is tit positioned such that the shortened chisel 33 of a hydraulically actuated impact hammer 25 impacts the strike plate 35 (embodying herein that such first lever side comprises a strike plate structured and arranged to receive such reciprocating impact forces from such impact-force transmitter) when the hydraulically-operated hammer 25 is operational and hammer-ripper attachment 29 is in place for operation. The strike plate 35 is preferably made of hardened steel.

The hydraulically actuated impact hammer 25 has an attaching bracket sub-assembly 72 preferably consisting of pair of spaced, parallel, apertured attaching plates shown as attaching plate 28 and attaching plate 40. Attaching plate 28 and attaching plate 40 are parallel to each other as well as in a plane perpendicular to the front casing face 80 (the face generally facing the excavator/backhoe 30) of the hydraulically actuated impact hammer 25. Attaching bracket sub-assembly 72 is preferably welded to the hydraulically-operated hammer face 80. As shown, attaching plates 28 and 40 include respective pivot-pin receiving apertures 60 and 61 and respective set-screw receiving apertures 68 and 69. When attaching plates 28 and 40 are mounted as shown, pivot-pin receiving apertures 60 and 61 are aligned for purposes of receiving a pivot-pin 31. Pivot-pin 31 includes screw-receiving apertures 70 and 71. Pivot-pin 31 is secured in its operative position by respective set screws 42 and 43 as shown. Preferably a strengthening bracket 19 is weldably attached along the bottom of the lever arm sub-assembly 26, as shown. The strengthening bracket 19 extends across the pivot angle 18 along the center vertical plane of the lever arm sub-assembly 26.

The connection of the lever arm sub-assembly 26 to the attaching bracket sub-assembly 72 of the hydraulically actuated impact hammer 25 is preferably accomplished by the aligning of the respective apertures 60, 61, and 59 of each respective welded attachment bracket 28, 40 and 55 and by utilizing a pivot-pin 31 slidably inserted into the aligned apertures (such connection embodying herein a tool connector structured and arranged to permit a removable connection to such force-transmitting tool). With reference again to FIG. 3 (a cross-section through this attached connection), it is seen that, preferably, as illustrated, pin sleeve 41 is situated within sleeve receiving aperture 59. And pivot pin 31 is placed within the aligned apertures 60 and 61 and aligned sleeve aperture 83. This arrangement is suitable to permit swiveling of hammer-ripper attachment 29 about pivot pin 31 so that it may swivel with respect to impact hammer 25.

As best shown in FIG. 4, a rear, upper, apertured spring attaching plate 47 is centered and mounted on the opposite side (facing generally away from excavator/backhoe 30) of the attaching plates 28 and 40 in a position to be directly above spring attaching plate 48 as well as in a plane parallel to those of attaching plates 28 and 40. Rear upper spring attaching plate 47 includes a spring-receiving aperture 62. Inserted into spring receiving aperture 62 is one end of return spring 32. The other end of spring 32 is inserted into spring receiving aperture 63 of plate 48, as shown. When the hydraulically actuated impact hammer 25 is fitted with the shortened chisel 33, and when the excavating hammer-ripper attachment 29 is operational, the shortened chisel 33 hits and moves the strike plate 35 generally downward, causing the lever arm spring receiving bracket 48 to stretch the return spring 32 by moving downwardly with respect to impact hammer 25. The return spring 32 exerts upward force on and suitably acts to pull the lever arm spring receiving bracket 48 back into its former position. Each such strike causes hammer-ripper attachment 29 to pivot about the pivot-pin 31.

When it is operated as herein set out, the excavating hammer-ripper attachment 29 can be used to impact or dig or chip materials such as large rock. When the hydraulically actuated impact hammer 25 is not operational, the hydraulic excavating apparatus 30 can continue to utilize the excavating hammer-ripper system 29 with normal movements to dig, chip, or impact materials with the ripper-type tooth body 86 and attached, removable chisel tooth attachment 27. This arrangement embodies herein a system for providing combination impact and other action for assisting in displacing material, comprising, in combination an impactor tool structured and arranged to provide a rapid series of power-driven impacts in a first direction, and a second tool, removably attached to such impactor tool, structured and arranged to provide an other action than impacting, and to be impacted upon by such impactor tool, and to combine impact action with such other action to act upon the material.

Figure 5:
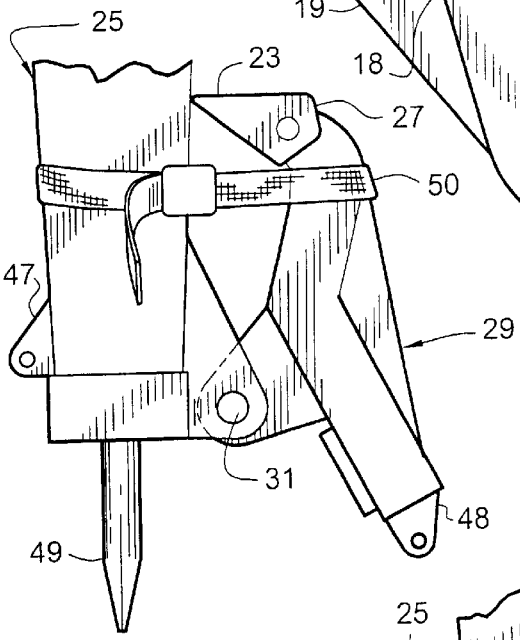
FIG. 5 is a partial side elevation view of the preferred embodiment of FIG. 1, illustrating the hammer-ripper in a stowed position.

FIG. 5 is a partial side elevation view of the preferred embodiment of FIGS. 1–4 of the excavating hammer-ripper attachment 29 of the present invention with the hammer-ripper attachment 29 shown in a stowed preferred position and a typical lengthened chisel 49 shown in place of the shortened chisel 33 previously shown in FIG. 4. As illustrated in FIG. 5, the excavating hammer-ripper attachment 29 is preferably restrained by restraining strap 50 in its stowed position. This restraining strap 50 is preferably made of leather. Preferably by applying appropriate constant pressure against the lever tooth end 23 of the excavating hammer-ripper attachment 29, the return spring 32 may be "compressed" or loosened and then unattached from the lever arm spring receiving bracket 48, thus allowing the excavating hammer-ripper attachment 29 to be placed in the preferred illustrated stowed position, permitting the hydraulically actuated impact hammer 25 to operate in its normal mode. This arrangement embodies herein a connector between such impact-force transmitter and such force redirector structured and arranged to provide connection both in an operating position and a stowed position, wherein such impact-force transmitter comprises a hydraulically actuated impact hammer, such connector is structured and arranged to permit normal operation of such hydraulically actuated impact hammer with such force redirector connected in a such stowed position, such force-transmitting tool comprises a ripper element; such ripper element comprises a tooth, and when in such stowed position, such second lever side of such force redirector is attachable with hydraulically actuated impact hammer. Further, the shortened chisel 33 adapted for this preferred embodiment of present invention is interchangeable with a lengthened chisel 49 as shown in FIG. 5. The lengthened chisel 49 is typically used for normal operation of the hydraulically actuated impact hammer 25.

Figure 6:
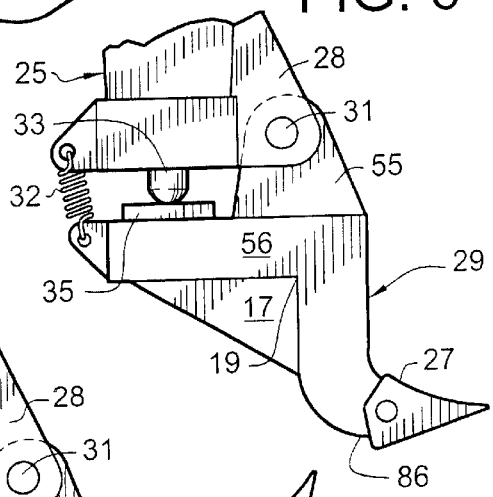
FIG. 6 is a partial side elevation view of another preferred embodiment of the hammer-ripper system of the present invention, shown in an operating position.

Illustrated in FIG. 6 is a partial side elevation view of another preferred embodiment of the excavating hammer-ripper attachment 29. In this preferred embodiment, the excavating hammer-ripper attachment 29 includes an alternate preferred lever arm 56 instead of previously-described lever arm 26. This alternate preferred embodiment of lever arm 56 is manufactured with about a 90-degree bend at bend 19 as illustrated in FIG. 6, thereby lowering the chisel tooth attachment 27 with respect to the plane of the lever arm strike plate 35. The lowered ripper-type tooth body 86 with attached removable chisel tooth attachment 27 (embodying herein that such ripper element comprises a tooth) allows for another angle of approach to the rock or other hardened material being removed. Preferably a strengthening bracket 17 is weldably attached along the bottom of the lever arm sub-assembly 56. The strengthening bracket 17 extends across the bend 19 along the center vertical plane of the lever arm sub-assembly 56.

Figure 7:
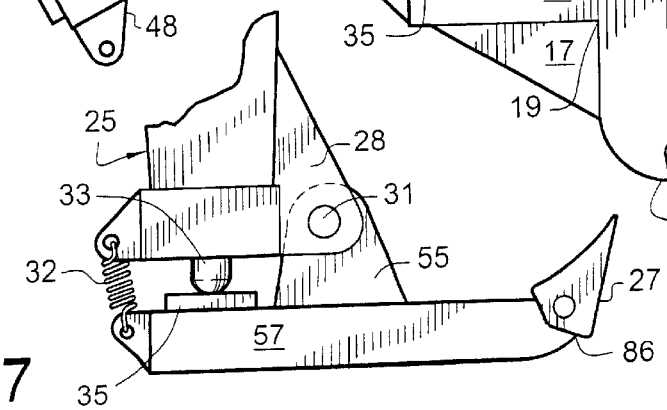
FIG. 7 is a partial side elevation view yet another preferred embodiment of the hammer-ripper system of the present invention, shown in an operating position.

FIG. 7 is a partial side elevation view of yet another preferred embodiment of the excavating hammer-ripper attachment 29 of the present invention, illustrating yet another alternate preferred embodiment of the lever arm 57. The lever arm 57 configuration is shown in FIG. 7 coupled with the same mounting configuration as previously discussed. Lever arm 57 is preferably, as illustrated in FIG. 7, structured to entirely be substantially in the same plane as that of lever arm strike plate 35. The ripper-type tooth body 86 with attached removable chisel tooth attachment 27 allows for another angle of approach to the rock or other hardened material being removed. In this embodiment a strengthening bracket preferably is not used.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. An excavator tool system for use with an excavator boom arm comprising at least two articulated segments, for providing combination impact and other forces during excavation of material, comprising, in combination:

a) a transmitting means for transmitting reciprocating impact forces in a first direction;

b) a direction-changing means, removably attached to said transmitting means, for receiving said reciprocating impact forces from said transmitting means and for changing said first direction of said reciprocating impact forces at least about 90 degrees to a second direction; and c) an impact means, connected with said direction-changing means, for providing combination impact, in said second direction, and other forces to the material;

d) wherein said transmitting means is adapted for attachment to the excavator boom arm.

2. The system according to claim 1 wherein said other forces comprise ripping forces.

3. The system according to claim 1 wherein said transmitting means comprises a hydraulically actuated impact hammer.

4. The system according to claim 1 wherein said direction changing means comprises a lever.

5. The system according to claim 1 wherein said impact means comprises a ripper tooth.

6. An excavator tool system for use with an excavator boom arm comprising at least two articulated segments, for providing combination impact and other forces during excavation of material, comprising, in combination:

a) an impact-force transmitter structured and arranged to transmit reciprocating impact forces in a first direction;

b) a force redirector, removably attached to said impact-force transmitter, structured and arranged to receive said reciprocating impact forces from said impact-force transmitter and to change said first direction of said reciprocating impact forces at least about 90 degrees to a second direction;

c) a force-transmitting tool, connected with said force redirector, structured and arranged to provide combination impact, in said second direction, and other forces to the material; and d) wherein said impact-force transmitter is structured and arranged to be attached to the excavator boom arm.

7. The system according to claim 6 further comprising an excavator apparatus including a boom arm connected to said impact-force transmitter.

8. The system according to claim 6 further comprising a connector between said impact-force transmitter and said force redirector structured and arranged to provide connection both in an operating position and a stowed position.

9. The system according to claim 8 wherein said impact-force transmitter comprises a hydraulically actuated impact hammer.

10. The system according to claim 9 wherein said connector is structured and arranged to permit normal operation of said hydraulically actuated impact hammer with said force redirector connected in a said stowed position.

11. The system according to claim 6 wherein said force-transmitting tool comprises a ripper element.

12. The system according to claim 11 wherein said ripper element comprises a tooth.

13. The system according to claim 6 wherein said force redirector comprises a lever having a pivot pin, a first lever side, and a second lever side.

14. The system according to claim 13 wherein said first lever side comprises a strike plate structured and arranged to receive said reciprocating impact forces from said impact-force transmitter.

15. The system according to claim 14 wherein said second lever side comprises a tool connector structured and arranged to permit a removable connection to said force-transmitting tool.

16. The system according to claim 15 wherein said pivot pin is mounted on said impact-force transmitter and said force redirector is rotatably mounted on said pivot pin.

17. The system according to claim 16 further comprising a connector between said impact-force transmitter and said force redirector structured and arranged to provide connection both in an operating position and a stowed position, wherein:

a) said impact-force transmitter comprises a hydraulically actuated impact hammer;

b) said connector is structured and arranged to permit normal operation of said hydraulically actuated impact hammer with said force redirector connected in a said stowed position;

c) said force-transmitting tool comprises a ripper element;

d) said ripper element comprises a tooth; and e) when in said stowed position, said second lever side of said force redirector is attachable with hydraulically actuated impact hammer.

18. The system according to claim 17 further comprising an excavator apparatus including a boom arm connected to said impact-force transmitter.

19. The system according to claim 15 wherein said tool connector comprises a return spring for said lever.

20. An excavator tool system for use with an excavator boom arm comprising at least two articulated segments, for providing combination impact and other action for assisting in displacing material, comprising, in combination:

a) an impactor tool structured and arranged to provide a rapid series of power-driven impacts in a first direction;

b) said impactor tool structured and arranged to be attached to the excavator boom arm; and c) a second tool, removably attached to said impactor tool, structured and arranged i) to provide an other action than impacting, and ii) to be impacted upon by said impactor tool and to transmit the power-driven impacts in a second direction at least about 90 degrees to the first direction, and iii) to combine impact action with said other action to act upon the material.

* * * * *